US006911786B2

(12) United States Patent
Qiu

(10) Patent No.: US 6,911,786 B2
(45) Date of Patent: Jun. 28, 2005

(54) CCFL CIRCUIT WITH INDEPENDENT ADJUSTMENT OF FREQUENCY AND DUTY CYCLE

(75) Inventor: Weiguang Qiu, Albany, CA (US)

(73) Assignee: Analog Microelectronics, Inc., Santa Clara, CA (US)

( * ) Notice: Subject to any disclaimer, the term of this patent is extended or adjusted under 35 U.S.C. 154(b) by 0 days.

(21) Appl. No.: 10/621,746

(22) Filed: Jul. 16, 2003

(65) Prior Publication Data

US 2005/0012470 A1 Jan. 20, 2005

(51) Int. Cl.[7] ..... H05B 37/02

(52) U.S. Cl. ..... 315/209 PZ; 315/247; 315/308

(58) Field of Search ..... 315/291, 55, 246–247, 315/293–294, 299, 307–308, DIG. 2, DIG. 5, DIG. 7, 209 PZ

(56) References Cited

U.S. PATENT DOCUMENTS 3,579,133 A * 5/1971 Harford ..... 330/283
5,548,189 A * 8/1996 Williams ..... 315/224
5,886,477 A * 3/1999 Honbo et al. ..... 315/209 PZ
5,923,542 A * 7/1999 Sasaki et al. ..... 363/16
6,016,052 A * 1/2000 Vaughn ..... 323/355
6,134,133 A 10/2000 Noma et al. ..... 363/134
6,226,196 B1 5/2001 Toshinari et al. ..... 363/134
6,239,558 B1 * 5/2001 Fujimura et al. ..... 315/307
6,278,625 B1 * 8/2001 Boyd ..... 363/132
6,348,755 B1 2/2002 Shimamura et al. ..... 310/318
6,400,096 B1 * 6/2002 Wells et al. ..... 315/224
6,566,821 B2 * 5/2003 Nakatsuka et al. ... 315/209 PZ
6,617,757 B2 * 9/2003 Vazquez Carazo et al. . 310/317
6,690,121 B1 * 2/2004 Weindorf ..... 315/247
6,747,421 B2 * 6/2004 Kohn ..... 315/291
2002/0121865 A1 * 9/2002 Nakatsuka et al. ... 315/209 PZ
2004/0021492 A1 * 2/2004 Terada et al. ..... 327/172
2004/0095117 A1 * 5/2004 Kernahan et al. ..... 323/282

* cited by examiner

*Primary Examiner*—Thuy Vinh Tran
(74) *Attorney, Agent, or Firm*—Bever, Hoffman & Harms, LLP; Jeanette S. Harms

(57) ABSTRACT

Two independent control variables, i.e. the frequency and the duty cycle of the driving waveform to an output driver, can be used to optimize the operation of a cold cathode fluorescent lamp (CCFL). The frequency of the driving waveform can be used to control the gain of a piezoelectric transformer (PZT) in a CCFL circuit. In contrast, the duty cycle of the driving waveform can be used to control the amplitude of the sinusoidal waveform at the PZT input terminal, and thus the current through the CCFL.

9 Claims, 9 Drawing Sheets

CCFL CIRCUIT WITH INDEPENDENT ADJUSTMENT OF FREQUENCY AND DUTY CYCLE

BACKGROUND OF THE INVENTION

1. Field of the Invention

The present invention relates to a cold cathode fluorescent lamp (CCFL) and in particular to a method of optimally operating the CCFL. This method includes adjusting the frequency of the driving waveform followed by adjusting the duty cycle of the driving waveform.

2. Description of the Related Art

Liquid crystal displays (LCDs) are well known in the art of electronics. One of the largest power consuming devices in a notebook computer is the backlight for its LCD. The LCD typically uses a cold cathode fluorescent lamp (CCFL) for backlighting. However, the CCFL requires a high voltage AC supply for proper operation. Specifically, the CCFL generally requires 600 Vrms at approximately 50 kHz. Moreover, the start-up voltage of the CCFL can be twice as high as its normal operating voltage. Thus, over 1000 Vrms is needed to even initiate CCFL operation.

In optimal applications, the battery in the notebook computer must generate the high AC voltages required by the CCFL. To increase valuable battery life, an efficient means is needed to convert this low voltage DC source into the necessary AC voltage. In the prior art, magnetic transformers, have provided the above-described conversion. However, in light of ever decreasing space limitations, magnetic transformers are becoming impractical in notebook applications.

To this end, piezoelectric transformers, which are generally much smaller than their magnetic transformer counterparts, are increasingly being used to provide the DC/AC conversion for the CCFL. A piezoelectric transformer (PZT) relies on two inherent effects to provide the high voltage gain necessary in a notebook application. First, in an indirect effect, applying an input voltage to the PZT results in a dimensional change, thereby making the PZT vibrate at acoustic frequencies. Second, in a direct effect, causing the PZT to vibrate results in the generation of an output voltage. The voltage gain of the PZT is determined by its physical construction, which is known to those skilled in the art and therefore not described in detail herein. Because the PZT has a strong voltage gain versus frequency relationship, the PZT should be driven at a frequency relatively close to its resonant frequency (e.g. within 10%).

FIG. 1A illustrates a prior art CCFL circuit 100A described in U.S. Pat. No. 6,239,558, issued to Fujimura et al. on May 29, 2001 (hereinafter Fujimura). CCFL circuit 100A includes two input lines 102 and 103 for controlling a half-bridge formed by p-type transistor 104 and n-type transistor 105. Input lines 102 and 103 receive non-overlapping clock signals, as shown in FIG. 1B. In one embodiment, clock signal 121, which is provided to the gate of p-type transistor 104, can vary between the voltage VBATT provided by a battery 101 (thereby turning off that transistor) and VBATT−VGS, wherein VGS is the gate to source voltage of transistor 104 (thereby turning on that transistor). In this embodiment, clock signal 122, which is provided to the gate of n-type transistor 105, can vary between voltages VGS (thereby turning on that transistor) and VSS (e.g. ground)(thereby turning off that transistor).

Optimally, either p-type transistor 104 or n-type transistor 105 is conducting at any point in time, thereby providing a pulsed square waveform at node N1 that varies between VSS and VBATT. However, realistically, some delay between conducting states of transistors 104 and 105 must be present for reliable operation. Thus, for example, delays 119 and 120 associated with clock signals 121 and 122 can be included to ensure that transistors 104 and 105 are not conducting at the same time, thereby preventing an undesirable energy loss.

In CCFL circuit 100A, an inductor 106 and a capacitor 107 function as a filter to transform the pulsed square waveform at node N1 into a sinusoidal waveform at node N2. Note that a PZT 108 of CCFL circuit 100 typically includes a large input capacitance. Therefore, in some embodiments, capacitor 107 can be eliminated.

PZT 108 includes two input terminals (represented by two horizontal plates in FIG. 1A) coupled respectively to node N2 and VSS as well as one output terminal coupled to a node N3. Of importance, the sinusoidal waveform at node N3 (at the output of PZT 108) has greater amplitude than the sinusoidal waveform at node N2 (at the input of PZT 108). In this manner, the input terminal of CCFL 110 receives a high potential AC signal.

The output terminal of CCFL 110, i.e. node N4, is coupled to VSS via a resistor 113. As explained by Fujimura, the current flowing through resistor 113 can be sensed at node N4 via line 118 and then converted from AC to DC using a rectifier (typically including one or more diodes to force the current in one direction) to provide a voltage that is proportional to the CCFL current. An error amplifier EA compares this rectified voltage to a set reference voltage and then outputs the difference between the two voltages as an amplified comparison result. This amplified signal controls a voltage-controlled oscillator (VCO) that outputs a frequency signal to a drive circuit. This drive circuit provides the non-overlapping clock signals to transistors 104 and 105.

Thus, the above described control loop uses frequency to control the current through CCFL 110. Specifically, as known by those skilled in the art, PZT 108 has a characteristic frequency response. FIG. 1C illustrates a graph plotting the voltage gain versus frequency for PZT 108, assuming that the effects of inductor 106 and capacitor 107 are ignored. Typically, as indicated by an output voltage curve 150, an initial driving frequency 151 of the PZT is started high and then reduced until the voltage gain exceeds a reference voltage 191, which corresponds to a CCFL minimum starting voltage (for example, to voltage gain 152). At this point, the CCFL begins operation, thereby introducing a load to the PZT, as indicated by output voltage curve 160.

The PZT attains optimal performance at its resonance frequency, i.e. at resonance frequency 163. However, the frequencies starting close to zero and increasing to resonance frequency 163 result in unstable and/or inefficient operation of the PZT and thus are not used. Therefore, during CCFL operation, the PZT is preferably maintained between frequencies 161 and 162.

Of importance, and referring back to FIG. 1A, varying the driving frequency of the non-overlapping clock signals on lines 102 and 103 has corresponding frequency changes on the pulsed waveform at node N1 and the sinusoidal waveform at nodes N2 and N3. As the frequency of these waveforms changes, the current through CCFL 110 also changes.

One of the disadvantages of CCFL circuit 10A is that a large change in input voltage-provided by battery 101 (e.g. 7–24 V) causes the driving frequency to vary widely. In particular, at high input voltages the driving frequency may increase significantly to maintain the tube current at the desired value. However, as noted with respect to FIG. 1C, the most efficient PZT operation occurs near resonance frequency 163. Therefore, a high frequency can force PZT 108 into an inefficient area of operation (i.e. into a low gain area).

FIG. 1D illustrates a CCFL circuit 100B, also described by Fujimura, for regulating the output voltage of PZT 108 by controlling the duty cycle. Note that similar reference numerals in the figures refer to similar components. In CCFL circuit 100B, resistors 111 and 112 are connected in series between node N3 and VSS, thereby forming a voltage divider. In this manner, a line 117 connected to node N5 between resistors 111 and 112 can be used to detect the output voltage of PZT 108 at node N3.

Once again, an error amplifier EA compares the rectified voltage to a set reference voltage. The amplified EA output signal controls a pulse width modulation (PWM) oscillation circuit. The output of the PWM oscillation circuit, in turn, controls the duty cycle of a driving waveform to the driver, which generates the non-overlapping clock signals to transistors 104 and 105. In one embodiment, as the duty cycle of this driving waveform increases, p-type transistor 104 conducts longer and n-type transistor 105 conducts less, thereby increasing the amplitude of the signal at node N3.

Thus, the control loop of CCFL circuit 100B attempts to regulate the brightness of CCFL 110 by controlling the duty cycle of the driving waveform to the driver based on the amplitude of the sinusoidal waveform at node N3. In an alternative embodiment described by Fujimura, resistors 111 and 112 can be connected to node N2 via line 116. This control loop would attempt to regulate the brightness of CCFL 110 by controlling the duty cycle of the driving waveform to the driver based on the amplitude of the sinusoidal waveform at node N2. However, because the sinusoidal waveform at nodes N2 and N3 are not symmetric about ground, a standard rectification scheme could incorrectly identify the midpoint of the sinusoidal waveform. Thus, the above-described control loops can incorrectly adjust the brightness of the current through CCFL 110. Therefore, a need arises for an improved system for powering a CCFL.

SUMMARY OF THE INVENTION

A method of optimizing performance of a cold cathode fluorescent lamp (CCFL) circuit is provided. The CCFL circuit can include a CCFL and a piezoelectric transformer (PZT) for driving the CCFL. In accordance with one aspect of the invention, a driving waveform is provided to the CCFL circuit. Of importance, a frequency of the driving waveform is based on a linearly translated input voltage, and a duty cycle of the driving waveform is based on a detected current through the CCFL. The linearly translated input voltage can be based on characteristics of the PZT in the CCFL circuit as well as a potential input voltage range for the CCFL circuit. Providing the driving waveform can include turning on/off transistors of a half bridge in the CCFL circuit.

In accordance with another aspect of the invention, optimizing performance of the CCFL circuit can take place before and during CCFL circuit operation. For example, before operation of the CCFL circuit, a frequency of a driving waveform for the CCFL circuit can be determined. The frequency can be based on a range of input source voltages as well as a range of desired linearly translated voltages associated with the PZT. During operation of the CCFL circuit, a duty cycle of the driving waveform can be adjusted based on a detected current through the CCFL.

A system for optimizing performance of the CCFL circuit is also provided. The system can include means for determining a frequency of a driving waveform for the CCFL circuit and means for adjusting a duty cycle of the driving waveform. The frequency can be based on a range of input source voltages and a range of desired linearly translated voltages associated with the PZT. The duty cycle can be based on a detected current through the CCFL.

The means for determining the frequency of the driving waveform can include a first resistor coupled between a node and a high voltage source (wherein the high voltage source is one voltage in the range of input source voltages), a second resistor coupled between the node and a low voltage source, an error amplifier having a positive input terminal connected to a reference voltage and a negative input terminal, and a third resistor coupled to the node, the negative input terminal of the error amplifier, and an output terminal of the error amplifier.

A linear voltage translator in accordance with one embodiment of the invention can include a first resistor coupled between a node and a high voltage source, wherein the high voltage source is one voltage in the range of input source voltages, a second resistor coupled between the node and a low voltage source, an error amplifier having a positive input terminal connected to a reference voltage and a negative input terminal, and a third resistor coupled to the node, the negative input terminal of the error amplifier, and an output terminal of the error amplifier. Of importance, the output terminal of the error amplifier can provide a signal to a voltage controlled oscillator (VCO) to determine an output frequency of the VCO.

DETAILED DESCRIPTION OF THE FIGURES

In accordance with one feature of the invention, two independent control variables, i.e. the frequency and the duty cycle of the driving waveform to an output driver, can be used to optimize cold cathode fluorescent lamp (CCFL) operation. Specifically, the frequency of the driving waveform can be used to control the gain of a piezoelectric transformer (PZT) in the CCFL circuit. In contrast, the duty cycle of the driving waveform can be used to control the amplitude of the sinusoidal waveform at the PZT input terminal, and thus the current through the CCFL.

Adjusting the frequency and the duty cycle simultaneously can result in the CCFL circuit being unstable. Therefore, in accordance with one feature of the invention, these control variables can be adjusted separately. This independent adjustment is possible based on the configuration of the CCFL circuit, wherein the frequency is a function of battery (i.e. input) voltage and the duty cycle is a function of the CCFL current.

Figure 1A:
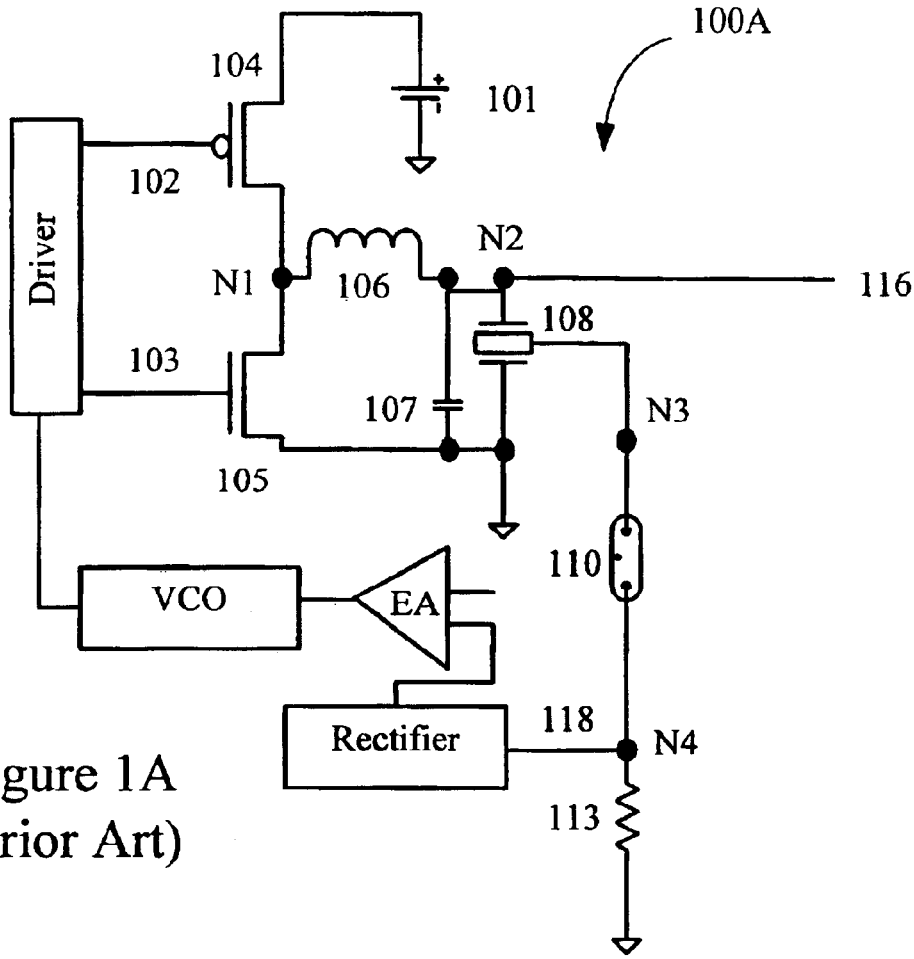
Figure 1A (Prior Art)
FIG. 1A illustrates a simplified prior art CCFL system for regulating the output voltage of a. PZT by controlling the frequency of a driving waveform.
Figure 1B:
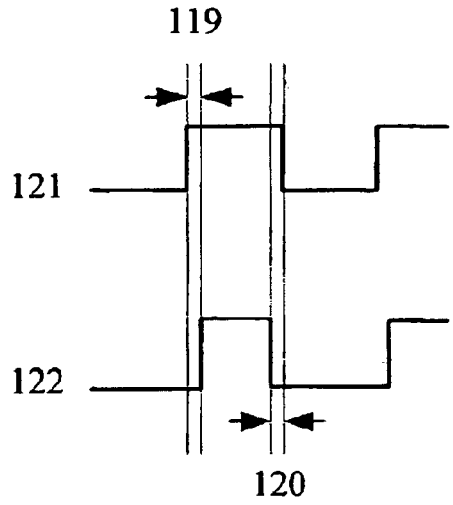
Figure 1B (Prior Art)
FIG. 1B illustrates non-overlapping clock signals that can be used to drive a half bridge in the CCFL circuit of FIG. 1A.
Figure 1D:
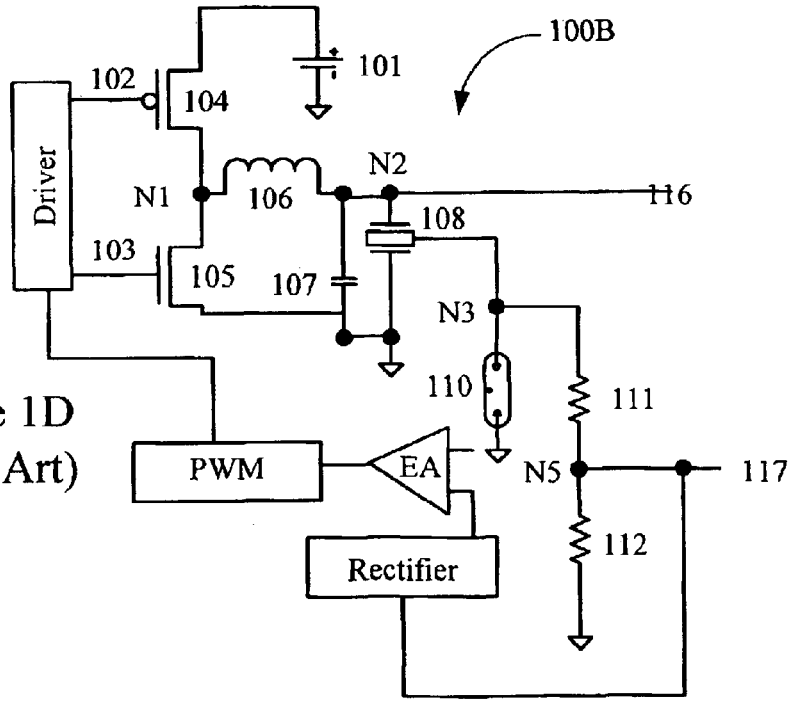
Figure 1D (Prior Art)
FIG. 1D illustrates a simplified prior art CCFL system for regulating the output voltage of a PZT by controlling the duty cycle of a driving waveform.
Figure 2:
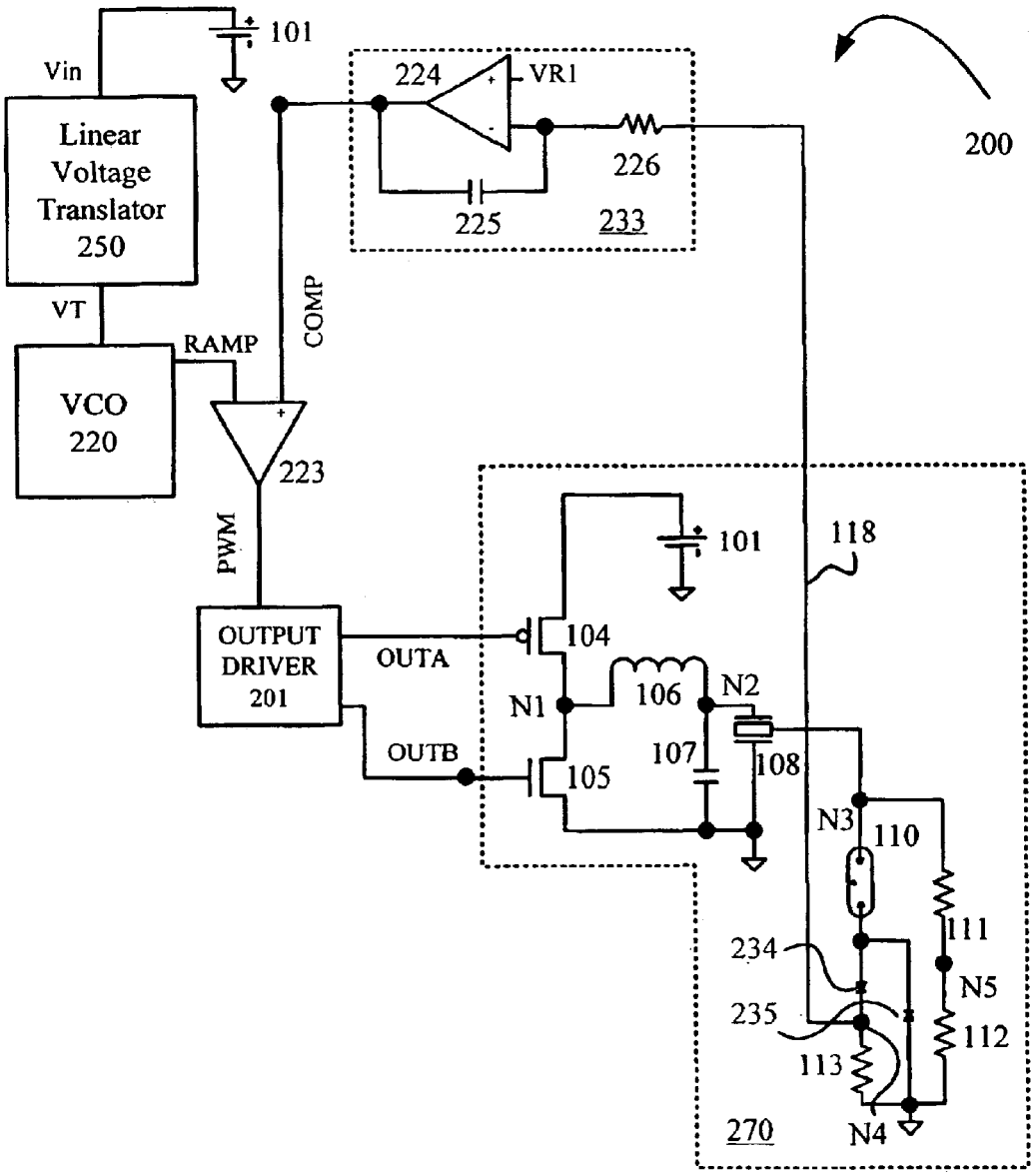
FIG. 2 illustrates a simplified CCFL system in accordance with the present invention that can optimize CCFL performance by adjusting both the frequency and the duty cycle of the driving waveform.

FIG. 2 illustrates a simplified CCFL system 200 that includes a CCFL circuit 270. CCFL circuit 270 includes the components described in detail in reference to CCFL circuits 100A and 100B (FIGS. 1A and 1D, respectively). CCFL circuit 270 further includes a diode 234 connected between the output terminal of CCFL 110 and resistor 113 as well as a diode 235 connected between the output terminal of CCFL 110 and VSS. In one embodiment, battery 101 can provide a voltage source between 7–24 V (typical for 3 lithium ion cells provided in a notebook computer application).

CCFL system 200 includes a first control loop connected to a node N4 that provides a DC signal COMP to a positive terminal of a comparator 223. System 200 further includes a VCO 220 that provides a signal RAMP (sawtooth waveform) to a negative terminal of comparator 223. The output signal of comparator 223, i.e. a PWM signal (a square waveform), is provided to an output driver 201, which in turn provides the non-overlapping clock signals OUTA and OUTB to transistors 104 and 105 (i.e. the driving waveforms to CCFL circuit 270).

First Control Loop Controls Duty Cycle

As described above, the current through CCFL 110 can be sensed on line 118, wherein the rectified voltage across resistor 113 (ensured by diodes 234 and 235) is proportional to the CCFL current. In accordance with one feature of the present invention, that voltage can drive an input of an integrator 233. Specifically, integrator 233 receives the voltage on line 118 through a resistor 226, wherein resistor 226 is coupled to the negative terminal of an error amplifier 224. Error amplifier 224 compares this voltage with a reference voltage VR1 received on its non-inverting terminal.

In one embodiment, reference voltage VR1 is derived from a temperature and supply stable reference (such as a bandgap reference) through a resistor divider. Other known techniques for providing reference voltage VR1 can also be used. In one embodiment, reference voltage VR1 can be between 0.5 V and 3.0 V. Note that the larger the reference voltage VR1, the larger the average voltage across resistor 113. In contrast, if reference voltage VR1 is too small, then error amplifier 224 offsets and other non-idealities may become significant. Therefore, in one embodiment, reference voltage VR1 can be 1.5 V.

A capacitor 225 is coupled to the negative terminal and the output terminal of error amplifier 224, thereby completing the formation of integrator 233. The purpose of integrator 233 is to generate a DC signal COMP such that the time-averaged voltage at node N4 is substantially equal to reference voltage VR1.

Driving Waveform Has Frequency

VCO 220 generates a saw tooth waveform called the RAMP signal, wherein the frequency of the RAMP signal is a function of the VCO control voltage. In general, increasing the input voltage increases the frequency. Of importance, the frequency of the RAMP signal generated by VCO 220 controls the frequency of the PWM signal generated by comparator 223 as well as the frequency of the sinusoidal waveform at node N2.

Figure 3:
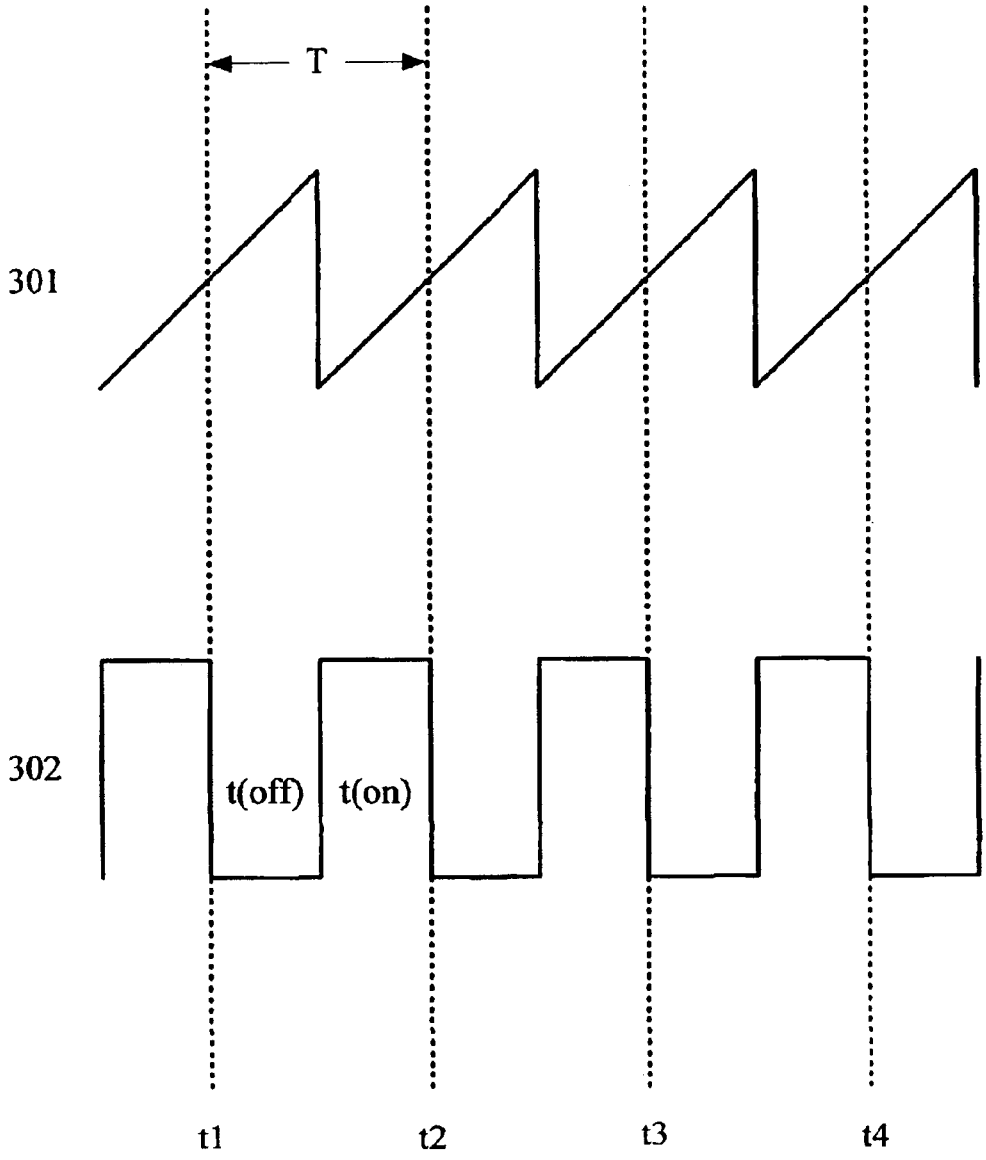
FIG. 3 illustrates exemplary waveforms for a VCO and a comparator, wherein the period T, and thus the frequency (i.e. 1/T) of these waveforms, is the same.

FIG. 3 illustrates exemplary waveforms 301 and 302 generated by VCO 220 and comparator 223, respectively, at times t1–t4. Because the period T of waveforms 301 and 302 is the same, the frequency (i.e. 1/T) also logically is the same.

Figure 1C:
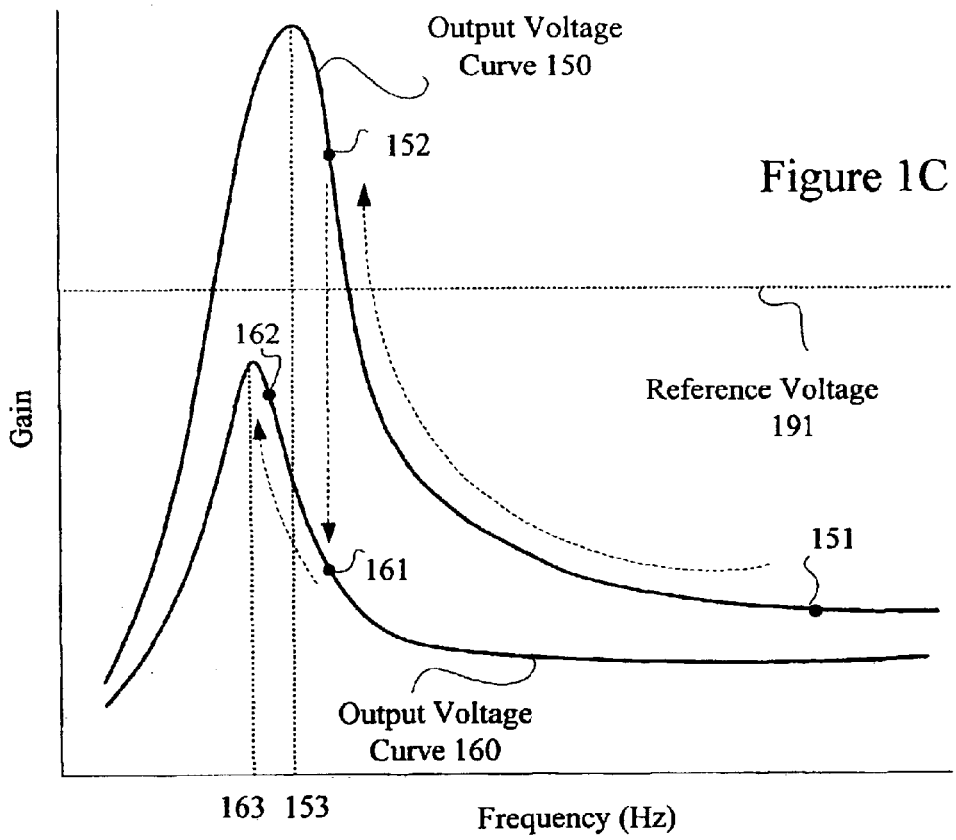
FIG. 1C illustrates a graph plotting the voltage gain versus frequency for a PZT in the CCFL circuit.

However, as noted with respect to FIG. 1C, as frequencies increase past resonance frequency 163, the gain undesirably decreases. Thus, irrespective of the input voltage to VCO 220, it would be desirable for the frequency of the RAMP signal (and thus the PWM signal and the sinusoidal waveform at node N2) to be within the range of frequencies 161 and 162, thereby ensuring an acceptable gain. The control voltage to VCO 220, i.e. voltage VT, has a direct relationship to the frequency of the RAMP signal.

Setting A Frequency Of The Driving Waveform

In accordance with one feature of the invention shown in FIG. 2, a linear voltage translator 250 can be used to provide an appropriately translated voltage VT to VCO 220. Specifically, within a known range of input voltages Vin to CCFL system 200, VCO 220 would preferably receive a predetermined range of voltages VT.

Of importance, the translated (also called control) voltage VT can be based on the PZT actually used in CCFL system 200. Specifically, the actual frequency/gain relationship (shown generically in FIG. 1C) can vary from one PZT to another. Therefore, the translated voltage VT can correspond to an actual voltage that when provided to VCO 220 will provide a frequency within a range of frequencies 161 and 162 for the actual PZT used in CCFL system 200. In one embodiment, input voltages Vin could include 7–24 V (i.e. the potential voltages of battery 101) and translated voltages VT could include 0–5 V. Therefore, linear voltage translator 250 can be advantageously used to provide a predetermined range of translated voltages VT to VCO 220 based on a known range of input voltages Vin to CCFL system 200.

Figure 4:
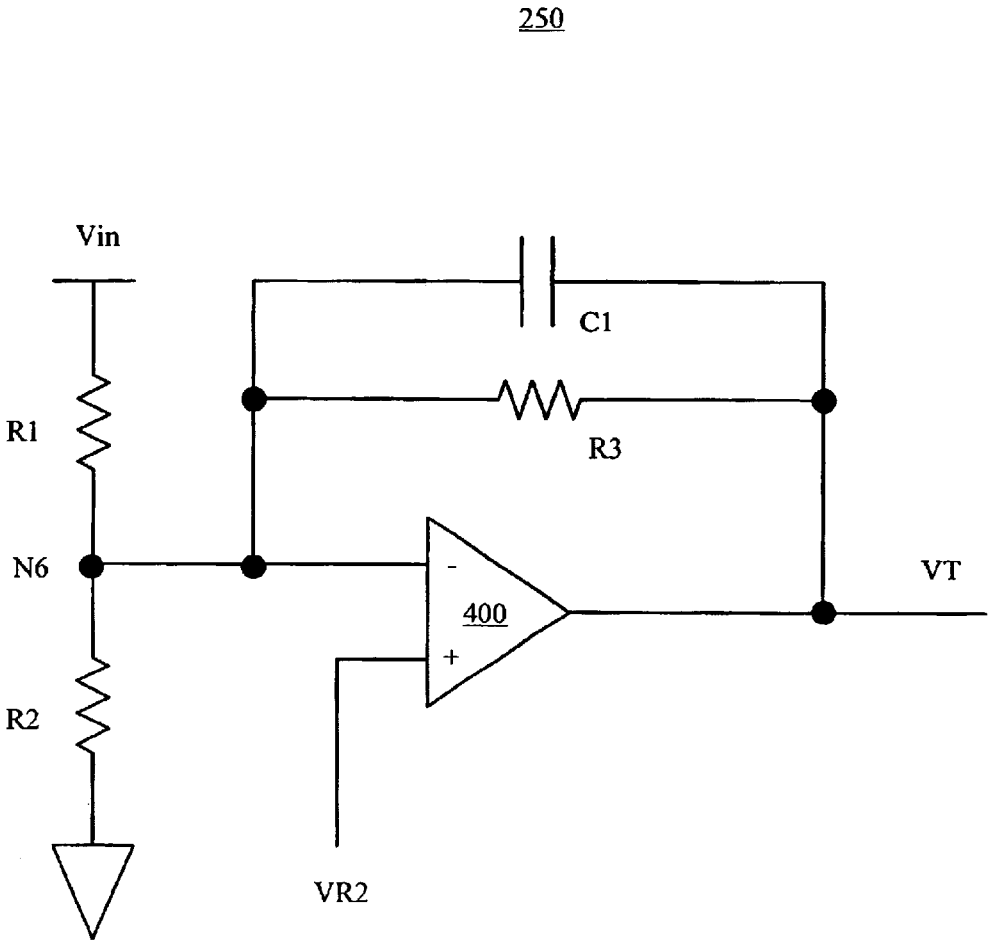
FIG. 4 illustrates an exemplary embodiment for a linear voltage translator.

FIG. 4 illustrates an exemplary embodiment for linear voltage translator 250. In this embodiment, two resistors R1 and R2 are connected in series between an input voltage (i.e. battery 101) and a voltage source VSS, thereby forming a voltage divider such that a node N6 (located between resistors R1 and R2) provides a voltage proportional to the voltage of battery 101. The voltage at node N6 drives the negative input terminal of an error amplifier 400. Error amplifier 400 compares the voltage at node N6 with a reference voltage VR2 received on its positive input terminal. Note that in general, reference voltage VR2 can be set in a manner similar to reference voltage VR1. A resistor R3 and a capacitor C1 are coupled in parallel between the negative input terminal and the output terminal of error amplifier 400. Capacitor C1, an optional component of linear voltage translator 250, can provide a smoothing function, specifically to filter out high frequency components of the signal.

In accordance with one feature of the invention, the values of resistors R1, R2, and R3 can be chosen to obtain the appropriate transfer function, i.e. VT=ƒ (Vin). The value of R1 can be chosen to be relatively large without being susceptible to parasitics. For example, in one embodiment, resistance R1 can be 100 kOhm to 1 Mohm.

The following equations can be used to compute resistances R2 and R3.

$$R2 = \frac{VR2(R1)(VT2 - VT1)}{VR2[(VT1 - VT2) + (Vin2 - Vin1)] - (VT1Vin2) + (Vin1VT2)}$$

$$R3 = R1\frac{VT1 - VT2}{Vin2 - Vin1}$$

wherein Vin1 is the lowest potential input voltage, and Vin2 is the highest potential input voltage, VT1 is the translated voltage when the input voltage Vin=Vin1, and VT2 is the translated voltage when the input voltage Vin=Vin2. Note that both resistances R2 and R3 are defined in terms of resistance R1. In one embodiment, the reference voltage VR2 can be 1.25 V, input voltage Vin1 can be 7 V, input voltage Vin2 can be 24 V, translated voltage VT1 can be 5 V, translated voltage VT2 can be 0 V, resistance R2 can be 67.6 kOhm, and resistance R3 can be 294 kohm.

Adjusting Duty Cycle Of The Driving Waveform

In accordance with another feature of the invention, the duty cycle of the driving waveform, i.e. the PWM signal, can be advantageously adjusted. In general, as the duty cycle of the driving waveform increases, output driver 201 (FIG. 2) turns on p-type transistor 104 longer and turns on n-type transistor 105 less, thereby increasing the amplitude of the sinusoidal waveform at node N2. Increasing the amplitude of the sinusoidal waveform increases the current through CCFL 110.

In contrast, as the duty cycle of the driving waveform decreases, output driver 201 (FIG. 2) turns on p-type transistor 104 less and turns on n-type transistor 105 longer, thereby decreasing the amplitude of the sinusoidal waveform at node N2. Decreasing the amplitude of the sinusoidal waveform at node N2 decreases the current through CCFL 110. Thus, the feedback loop including line 118 and integrator 233 allows CCFL system 200 to automatically adjust the duty cycle of the driving waveform, i.e. the PWM signal.

Performing Optimization Before/During Operation Of CCFL System

Figure 5:
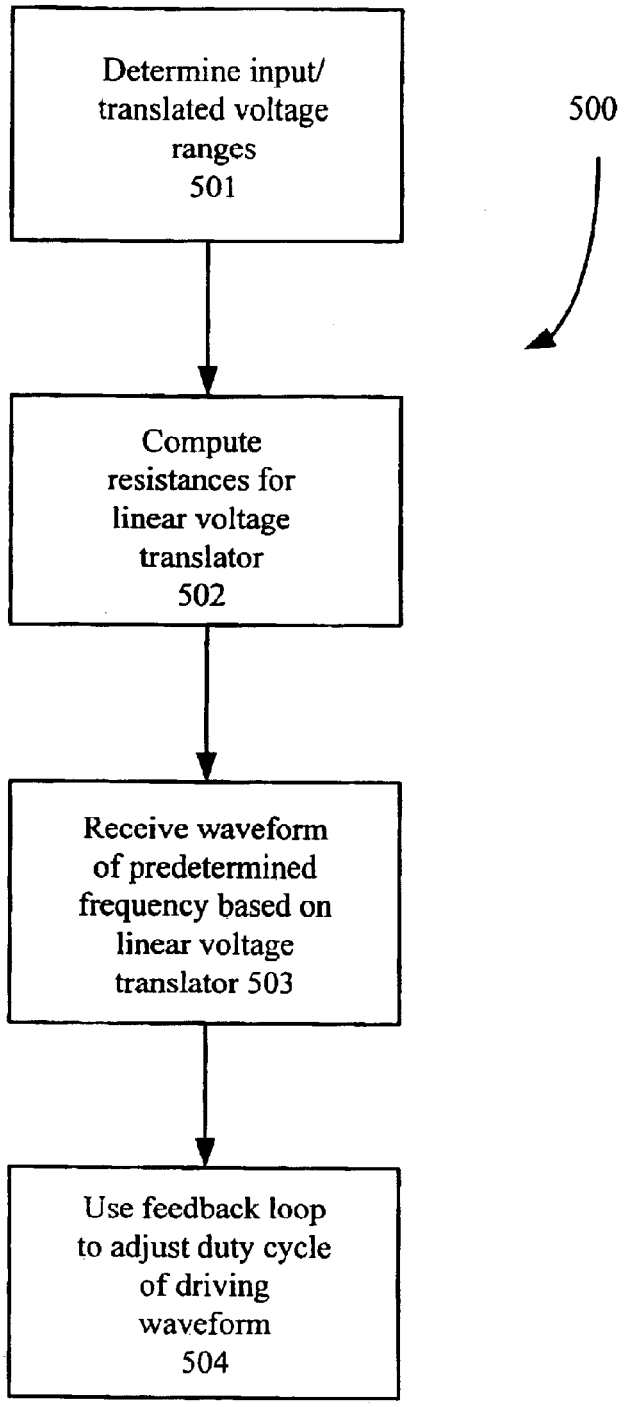
FIG. 5 illustrates an exemplary method for optimizing the operation of a CCFL circuit.

FIG. 5 illustrates an exemplary method 500 for optimizing the operation of a CCFL circuit including a PZT. In step 501, an input voltage range for the CCFL system including the CCFL circuit can be determined. This input voltage range can include a minimum input voltage as well as a maximum input voltage. For example, the minimum/maximum input voltages could be the potential voltage source ranges of a battery to be used in the CCFL system, e.g. 7 V and 24 V.

In step 501, a translated voltage range can also be determined. This translated voltage range can include a minimum translated voltage as well as a maximum translated voltage. In one embodiment, the minimum/maximum translated voltages VT can correspond to the actual voltages that when provided to a VCO in the CCFL system will provide the maximum/minimum desired frequencies for the actual PZT in the CCFL system. For example, the minimum/maximum translated voltages could be 0 V and 5 V.

The voltage ranges determined in step 501 facilitate computing the resistances of a linear voltage translator in step 502. In one embodiment, the linear voltage translator includes three resistors that can advantageously translate any voltage in the potential input voltage range into a voltage in the potential output voltage range. In this manner, and described in reference to step 503, the frequency of the driving waveform can be optimized based on the PZT in the system. Note that steps 501 and 502 can be performed before operation of the CCFL system.

In step 503, which can be performed during operation of the CCFL system, the VCO in the CCFL system can receive an actual input voltage (which is within the potential input voltage range) and then generate a RAMP waveform having a predetermined frequency. Of importance, the RAMP waveform sets the frequency of the driving waveform to the predetermined frequency. The frequency of the driving waveform in turn determines the sinusoidal waveform at node N2, which controls the gain provided by the PZT. In particular, the predetermined frequency ensures that the PZT can provide an optimal gain (e.g. within +10% of the resonance frequency).

In step 504, which can also be performed during operation of the CCFL system, a feedback loop from an output terminal of the CCFL can be used to adjust the duty cycle of the driving waveform. This duty cycle can be modified until the current through the CCFL is optimized.

Therefore, in summary, optimizing operation of the CCFL circuit includes setting an appropriate gain for the PZT using a frequency of the driving waveform and then modifying the current of the CCFL using the duty cycle of the driving waveform.

CCFL System Embodiment

Figure 6:
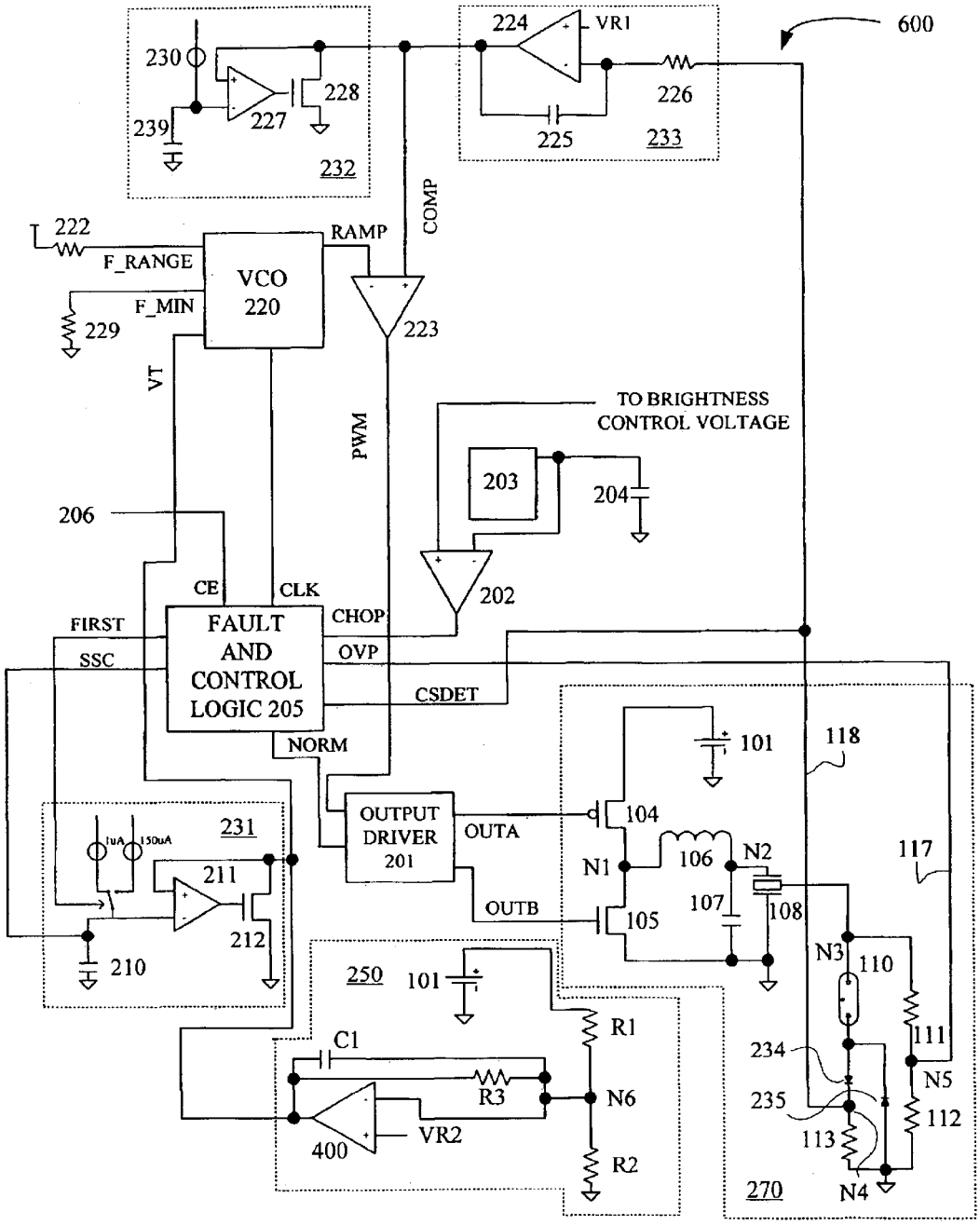
FIG. 6 illustrates an exemplary CCFL system that can optimize operation of a CCFL circuit using the linear voltage translator and the feedback loop described in reference to FIGS. 2 and 4.

FIG. 6 illustrates a CCFL system 600 that can optimize operation of CCFL circuit 270 using the linear voltage translator and the first control loop described in reference to FIGS. 2 and 4. Note that components with like reference numerals have the same functionality.

In this embodiment, the minimum operating frequency of VCO 220 can be set by a resistor 229, which is coupled to supply voltage VSS. Moreover, the adjustment range of VCO 220 can be set by a resistor 222, which is coupled to a supply voltage VDD. Note that resistors 222 and 229 set a broader frequency range (i.e. the absolute minimum and maximum frequencies) for VCO, whereas resistors R1, R2, and R3 (together with resistors 222 and 229) set a narrower frequency range. For example, in one embodiment, resistors 222 and 229 could set a frequency range between 54 kHz and 60 kHz, whereas resistors R1, R2, and R3 (together with resistors 222 and 229) could set a frequency range between 55 kHz and 56 kHz.

In one embodiment, the COMP signal generated by integrator 233 can be limited by a clamping circuit 232. Clamping circuit 232 includes an error amplifier 227 providing an output signal to the gate of a transistor 228. Transistor 228, an n-type transistor, has its source coupled to VSS and its drain coupled to the positive input terminal of error amplifier 227 as well as to the output of integrator 233. Error amplifier 227 further includes a negative input terminal coupled to a current source 230 and one terminal of a capacitor 239 (the other terminal being coupled to VSS). In this configuration, clamping circuit 232 allows the COMP signal to increase at a rate that is no faster than current source 230 can charge capacitor 239. Thus, clamping circuit 232 prevents the COMP signal (and thus the PWM signal) from immediately going to its full power mode, thereby allowing CCFL 110 to start up slowly. Having a gradual increase of the power to CCFL 110 advantageously prolongs its life as well as the life of other components of CCFL circuit 270.

Start-Up Operations

In one embodiment, the translated voltage VT can be limited by a clamping circuit 231. Clamping circuit 231 includes an error amplifier 211 providing an output signal to the gate of a transistor 212. Transistor 212, an n-type transistor, has its source coupled to VSS and its drain coupled to the positive input terminal of error amplifier 211 as well as to the output of integrator 231. In this configuration, clamping circuit 231 allows the translated voltage VT to increase at a rate that is no faster than a selected current source can charge a capacitor 210. Specifically, in this embodiment, clamping circuit 231 further includes two circuit sources, one at 1 uA and another at 150 uA, which are selectively connected to the negative input terminal of error amplifier 211 as well as to one terminal of capacitor 210. Capacitor 210 has its other terminal connected to VSS. In one embodiment, capacitor 210 has a low capacitance of 0.022 uF.

During a "cold" start-up operation of CCFL 110, i.e. a start-up following a predetermined period of time in which CCFL 110 has been off, fault and control logic 205 generates an active signal FIRST, thereby resulting in clamping circuit 231 selecting the lower value current source (i.e. 1 uA, in this embodiment). In contrast, during subsequent "warm" starts, i.e. a start-up following a timeperiod less than the predetermined period of time, fault and control logic 205 generates an inactive signal FIRST, thereby resulting in clamping circuit 231 selecting the higher value current source (i.e. 150 uA). In this manner, capacitor 210 takes longer to charge during a cold start-up than a warm start-up.

If error amplifier 211 receives a lower voltage on its negative input terminal compared to the translated voltage VT received on its positive input terminal, then the output of error amplifier 211 increases, thereby turning on transistor 212 and providing a pull-down on the VT line. If error amplifier 211 receives a higher voltage on its negative input terminal compared to the translated voltage VT received on its positive input terminal, then the output of error amplifier 211 decreases, thereby turning off transistor 212 and allowing the voltage on the VT line to increase as controlled by integrator 230. In this manner, the present invention ensures that a cold start-up for CCFL 110 is much slower than warm start-ups.

CCFL Dimming

Dimming can be accomplished by turning CCFL 110 on and off at a frequency that is higher than the human eye can detect, but much lower than the driving frequency of the CCFL. For example, if the driving frequency of CCFL 110 is 50 kHz, then the dimming frequency might be 200 Hz. As the duty cycle of the on/off signal goes from 0 to 100% then the average tube brightness will also vary from 0 to 100%. In one embodiment, a ramp generator 203 can generate a sawtooth waveform that is limited by a small capacitor 204. In one embodiment, capacitor 204 has a capacitance of 0.015 uF. A comparator 202 can compare this sawtooth waveform with a BRIGHTNESS CONTROL VOLTAGE, e.g. a DC voltage, which is proportional to the desired brightness. Based on this comparison, comparator 202 outputs a variable duty factor signal CHOP.

The CHOP signal can stop output driver 201 from switching and can also reset capacitors 210 and 239 to 0 volts. Thus, when the CHOP signal is active, clamping circuits 231 and 232 significantly limit the voltage on the COMP and VT lines, thereby ensuring smooth dimming operations with very little overshoot.

Second Control Loop

A second control loop in CCFL system 600 can determine undesirable voltages provided across CCFL 110. Specifically, the second control loop includes two resistors 111 and 112 coupled between node N3 and VSS, thereby forming a voltage divider. In this configuration, a node N5 between transistors 111 and 112 provides an OVP signal proportional to the voltage across CCFL 110. Node N5 is connected to fault and control logic 205 via line 117. If the OVP signal (and thus CCFL voltage) is too high, then a long active CHOP signal generated by fault and control logic 205 can actually shut down CCFL circuit 270 to prevent potentially dangerous conditions from developing. In other words, if the voltage at node N3 is too high, then fault and control logic 205 will turn off the chip regardless of the current operating mode.

In one embodiment, fault and control logic 205 is semi-disabled for a predetermined period of time after either a cold or warm start-up. This semi-disabled period is desirable because CCFL voltages both above and below normal can be experienced when the voltages on capacitors 210 and 239 are ramping upwards. As noted above, there is no "blanking" period for the over-voltage check. However, fault and control logic 205 can also check to see that there are no under-voltages at node N3. In one embodiment, the under-voltage fault check must receive four consecutive periods of under-voltage operation before fault and control logic 205 generates a fault signal and shuts the chip down. In this manner, fault and control logic 205 prevents an unwanted shutdown down to a single spurious under-voltage event. After the semi-disabled time, fault and control logic 205 can again be fully enabled.

Fault and control logic 205 can also receive a CSDET signal from node N4. Thus, fault and control logic 205 can look for under-voltage conditions (tube under-current) at node N4. Once again, this fault check can be disabled for a certain period after each start up cycle (similar to the under-voltage check of node N3). In one embodiment, fault and control logic 205 must receive four consecutive periods of under-voltage operation at node N4 before fault and control logic 205 generates a fault and shuts the chip down.

Exemplary Layout For CCFL System

Figure 7:
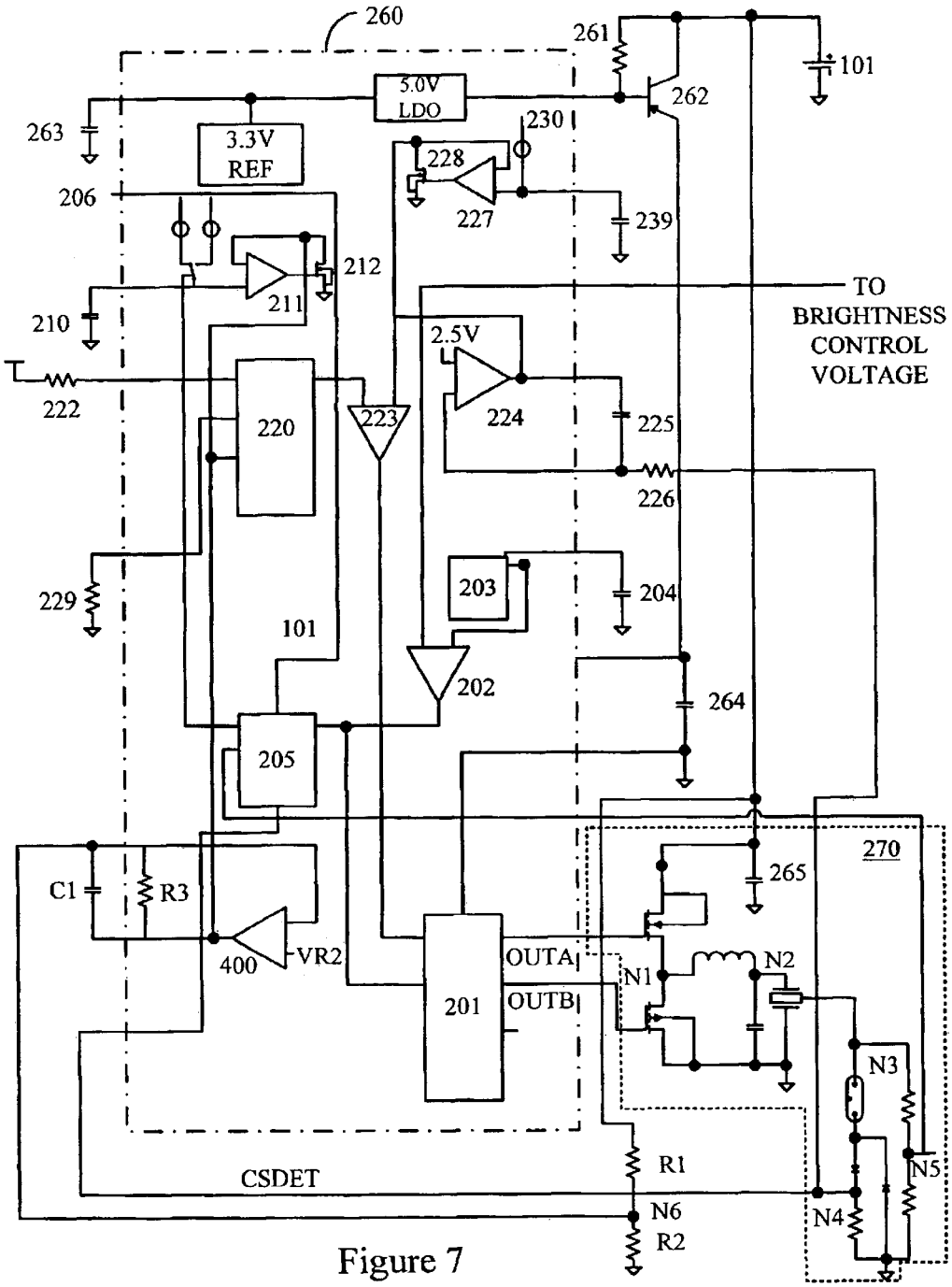
FIG. 7 illustrates one layout for the CCFL system of FIG. 6.

FIG. 7 illustrates one layout for CCFL system 600 of FIG. 6. Note that similar reference numerals denote similar components. Additional components may be included in an actual implementation of CCFL system 600. Such additional components can include, for example, a resistor 261, a pnp transistor 262, as well as capacitors 263, 264, and 265. Capacitor 263 functions to regulate the on-chip reference voltage. Capacitor 264, pull-up resistor 261, and pnp transistor 262 form a linear regulator that can provide a VDD supply voltage from battery 101. Capacitor 265, in this embodiment can serve as a bypass capacitor, which effectively regulates the high AC current from battery 101. A dashed box 260 indicates that the components therein can be fabricated on one chip.

Exemplary VCO Configuration

Figure 8:
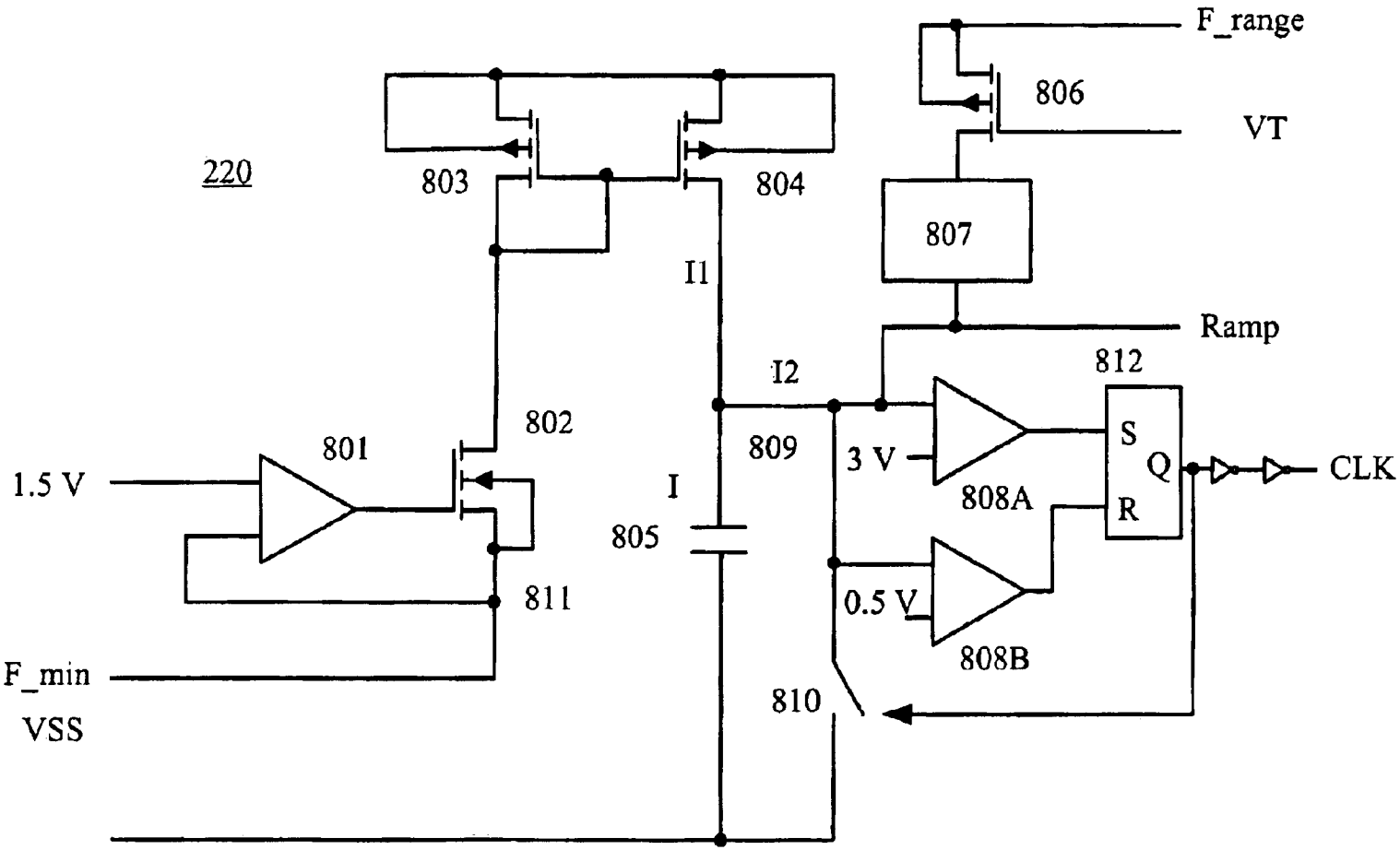
FIG. 8 illustrates an exemplary VCO that can be used with the linear voltage translator.

FIG. 8 illustrates an exemplary VCO 220, which is a CMOS relaxation oscillator. Specifically, when node 809 is high (e.g. 3 V), then the feedback signal from amplifiers 808A and 808B (via set-reset flip-flop 812) closes switch 810, thereby rapidly discharging a capacitor 805. In contrast, when node 809 is low (i.e. less than 0.5 V), then the feedback signal opens switch 810, thereby allowing capacitor 805 to charge based on the currents generated by a current mirror, which includes transistors 802/803 and a current divider 804. This charge and discharge cycle creates the clock signal CLK on the output of amplifier 808.

Of importance, the currents and voltage at node 809 and the capacitance of capacitor 805 determine the frequency of the oscillation in VCO 220. That is, I=I1+I2. Therefore, the frequency of VCO 220 would be computed by the equation (I1+I2)/(C×V), wherein C is the capacitance of capacitor 805 and V is the ramp amplitude at node 809. Note that II is determined by resistor 229, whereas 12 is determined by resistor 222 (see FIG. 6) and the VT signal.

In this embodiment of VCO 220, amplifier 801 and transistor 802 are configured to ensure the reference voltage (e.g. 1.5 V) is reliably transferred to node 811. This voltage in combination with the resistance of resistor 229 can then provide a stable current to the current mirror.

A transistor 806 is typically sized to provide a large current. However, only a small current is actually needed for I2(i.e. current I1 mainly charges capacitor 805). Therefore, a current divider 804, in this embodiment a 50:1 current divider, can be used to provide the appropriate contribution of current.

Thus, if the contribution of I2 is zero, then VCO 220 would-provide-only the minimum frequency, as set by resistor 229. Assuming there is some current contribution by I2, then current I2 (which is determined by resistor 222) determines the frequency range (i.e. the maximum allowed frequency) of VCO 220.

Other Embodiments

Additional information regarding CCFL system 600 and its layout is provided in U.S. patent application Ser. No. 10/083,932, entitled "System and Method For Powering Cold Cathode Fluorescent Lighting", filed on Feb. 26, 2002 by Analog Microelectronic, Inc., which is incorporated by reference herein.

Various embodiments of the present invention have been described herein. Those skilled in the art will recognize various component replacements or modifications that can be made to those embodiments. For example, although the half bridge described herein includes a p-type transistor and an n-type transistor, other embodiments could include bridges including only n-type transistors. Moreover, although the linear voltage translator described herein includes three resistors, other embodiments may include more or less resistors. Note that the linear voltage translator may include components other than or in addition to the illustrated resistors. Irrespective of implementation, these components would ensure that a potential input voltage range can be translated into an output voltage range consistent with the PZT used in the system. Therefore, the scope of the present invention is only limited by the appended claims.

What is claimed is:

1. A method of optimizing performance of a cold cathode fluorescent lamp (CCFL) circuit, the CCFL circuit including a CCFL and a piezoelectric transformer (PZT) for driving the CCFL, the method comprising:

providing a driving waveform to the CCFL circuit, wherein a frequency of the driving waveform is based on a linearly translated input source voltage, and wherein a duty cycle of the driving waveform is based on a detected current through the CCFL.

2. The method of claim 1, wherein the linearly translated input source voltage is based on characteristics of the PZT in the CCFL circuit.

3.The method of claim 2, wherein the linearly translated input source voltage is based on a potential input voltage range for the CCFL circuit.

4. The method of claim 1, wherein providing the driving waveform includes turning on/off transistors of a half bridge in the CCFL circuit.

5. A method of optimizing performance of a cold cathode fluorescent lamp (CCFL) circuit, the CCFL circuit including a CCFL and a piezoelectric transformer (PZT) for driving the CCFL, the method comprising:

before operation of the CCFL circuit, determining a frequency of a driving waveform for the CCFL circuit, wherein the frequency is based on a range of input source voltages and a range of desired linearly translated source voltages associated with the PZT; and during operation of the CCFL circuit, adjusting a duty cycle of the driving waveform based on a detected current through the CCFL.

6. A system for optimizing performance of a cold cathode fluorescent lamp (CCFL) circuit, the CCFL circuit including a CCFL and a piezoelectric transformer (PZT) for driving the CCFL, the system comprising:

means for determining a frequency of a driving waveform for the CCFL circuit, wherein the frequency is based on a range of input source voltages and a range of desired linearly translated source voltages associated with the PZT; and means for adjusting a duty cycle of the driving waveform based on a detected current through the CCFL.

7. The system of claim 6, wherein the means for determining the frequency of the driving waveform includes:

a first resistor coupled between a node and a high voltage source, wherein the high voltage source is one voltage in the range of input source voltages;

a second resistor coupled between the node and a low voltage source;

an error amplifier having a positive input terminal connected to a reference voltage and a negative input terminal; and a resistor coupled to the node, the negative input terminal of the error amplifier, and an output terminal of the error amplifier.

8. A linear voltage translator comprising:

a first resistor coupled between a node and a high voltage source, wherein the high voltage source is one voltage in a range of input source voltages;

a second resistor coupled between the node and a low voltage source;

an error amplifier having a positive input terminal connected to a reference voltage and a negative input terminal; and a third resistor coupled to the node, the negative input terminal of the error amplifier, and an output terminal of the error amplifier.

9. The linear voltage translator of claim 8, wherein the output terminal of the error amplifier provides a signal to a voltage controlled oscillator (VCO) to determine an output frequency of the VCO.

* * * * *